United States Patent [19]

Kwak

[11] Patent Number: 4,653,188

[45] Date of Patent: Mar. 31, 1987

[54] RAZOR CONTAINING SHAVING CREAM DISPENSER THEREIN

[76] Inventor: Kyu H. Kwak, 11308 Grandview Ave., Wheaton, Md. 20902

[21] Appl. No.: 838,832

[22] Filed: Mar. 12, 1986

[51] Int. Cl.[4] ..... B26B 19/44

[52] U.S. Cl. ..... 30/41; 30/86

[58] Field of Search ..... 30/41, 86, 90, 85, 41.5

[56] References Cited

U.S. PATENT DOCUMENTS

| | | | |
|---|---|---|---|
| 1,335,840 | 4/1920 | Kaylor | 30/41 |
| 1,892,836 | 1/1933 | Harvey | 30/86 X |
| 4,562,643 | 1/1986 | Cataudella | 30/86 |

*Primary Examiner*—Douglas D. Watts

*Attorney, Agent, or Firm*—Birch, Stewart, Kolasch & Birch

[57] ABSTRACT

A razor containing a shaving cream dispenser comprising a body member having a chamber disposed therein and a handle member slidably disposed thereon, the chamber containing a shaving cream dispenser disposed therein, a head member disposed at one end of the body member, and a removable cap disposed at the other end of the body member whereby the shaving cream is dispensed from the shaving cream dispenser through the head member by pressing the handle member against the shaving cream dispenser.

6 Claims, 6 Drawing Figures

RAZOR CONTAINING SHAVING CREAM DISPENSER THEREIN

BACKGROUND OF THE INVENTION

The present invention relates to a razor containing a shaving cream dispenser therein, and more particularly to an improved razor enclosing a flexible shaving cream dispenser whereby when shaving the shaving cream is caused to flow from the shaving cream dispenser to the mouth of the razor by pressing a handle against the cream dispenser.

Many types of razors are known which do not house a shaving cream therein. Accordingly, these razors need a separate shaving cream container and thus it is very inconvenient to carry such containers, particularly when travelling. Thus, none of the known conventional razors provide a razor containing a flexible shaving cream dispenser disposed therein which is very convenient to use and which can be used a multiplicity of times by merely changing the cream dispenser.

OBJECTS AND SUMMARY OF THE INVENTION

Accordingly, it is an object of the present invention to provide an improved razor containing a shaving cream dispenser disposed therein.

Another object of the present invention is to provide a razor containing a shaving cream dispenser disposed therein which is changeable.

A further object of the present invention is to provide a razor containing a shaving cream dispenser whereby when the razor is operated, the shaving cream is caused to immediately flow to the head of the razor by pressing a handle provided on the razor.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to a razor containing a shaving cream dispenser disposed therein whereby the shaving cream of the dispenser is caused to flow to the shaving head to be applied to the face by merely pressing a handle on the razor which dispenses the shaving cream as needed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
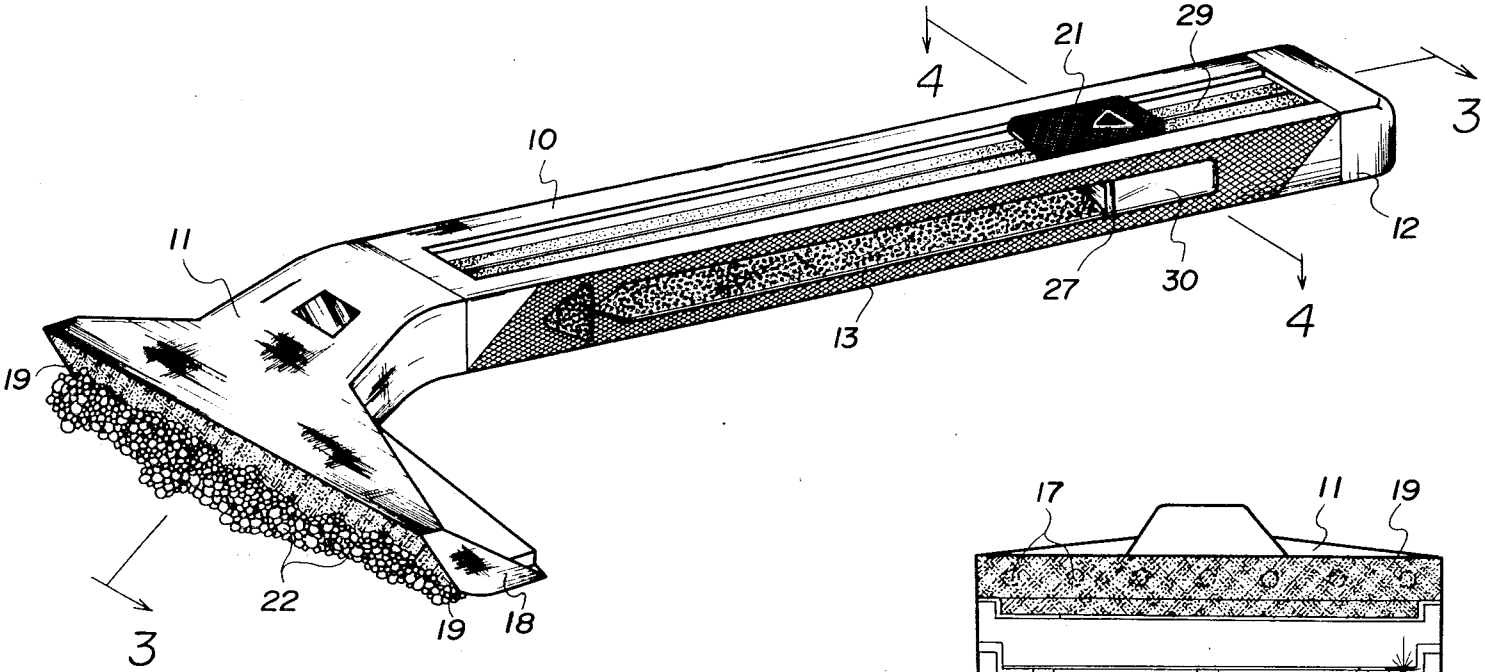
FIG. 1 is a perspective view of a razor containing a shaving dispenser of the present invention.
Figure 2:
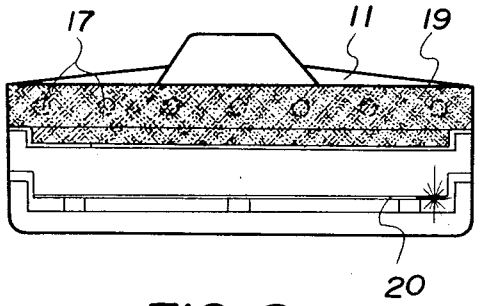
FIG. 2 is a front view of the head portion of the razor of the present invention.
Figure 4:
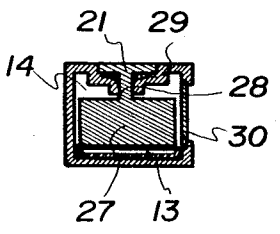
FIG. 4 is a cross-sectional view taken along line 4—4 of FIG. 1.
Figure 3:
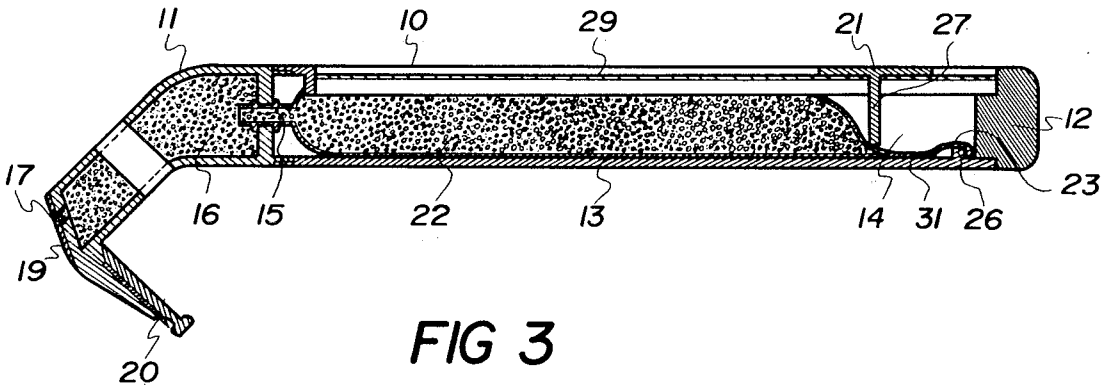
FIG. 3 is a cross-sectional view taken along line 3—3 of FIG. 1.
Figure 6:
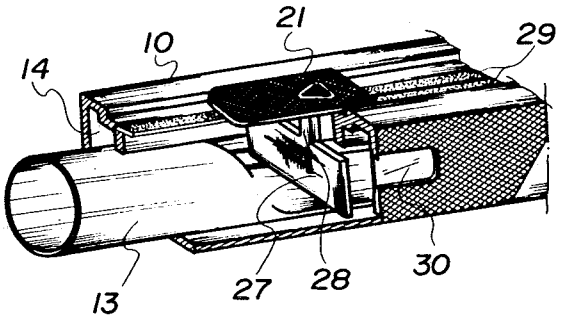
FIG. 6 is a perspective view with a portion cut away showing the rear portion of the razor of the present invention.
Figure 5:
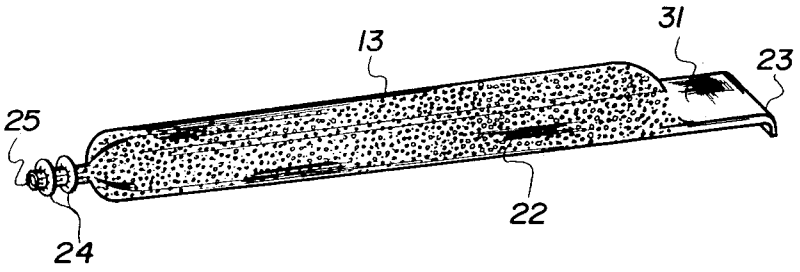
FIG. 5 is a perspective view of the shaving cream dispenser of the present invention.

Referring now in detail to the drawing for the purpose of illustrating the present invention, the razor containing a shaving cream dispenser as shown in FIGS. 1 and 3 comprises a body member 10, a "T"-shaped head member 11 disposed at one end of the body member 10 and a removable cap 12 disposed at the other end thereof. The body member 10 is provided with a chamber 14 for housing a shaving cream dispenser 13 containing shaving cream 22 therein. The shaving cream dispenser 13 is made of flexible materials such as rubbers or plastics. The head member 11 is provided with a head chamber 16 for conveying the shaving cream 22 from the cream dispenser 13 through a plurality of small holes 17 at the front side of a head 18 to a cotton surface plate 19. A blade 20 extends along the side of the head 18 as shown in FIG. 2. The shaving cream dispenser 13 has an outlet tube 25 disposed at one end thereof and a hook-like member 23 disposed at the other end thereof to engage a raised portion 26 located on the inside of the chamber 14 (see FIG. 5). The outlet tube 25 includes a pair of stop members 24 which engage both sides of a hole 15 positioned in a portion which separates the chamber 14 from the head chamber 16. Also, the shaving cream dispenser 13 includes a rear flat portion 31 which enables a pressing plate 27 attached to a handle member 21 to be applied against the rear of the shaving cream dispenser 13. As shown in FIGS. 4 and 6, the handle member 21 is connected to the pressing plate 27 by a connecting member 28. The connecting member 28 is sealed at the top of the body member 10 by rubber gaskets 29 disposed on the body member 10. Thus, the shaving cream 22 can be dispensed from the dispenser 13 by pushing the handle member 21 along the top of the body member. The body member 10 is provided with a transparent portion 30 at one side thereof for indicating the amount of the shaving cream 22 available in the dispenser. As the handle member 21 along the body member 10, the rubber gaskets 29 will close together sealing the body member 10.

In operation, after removing the cap 12 and the handle member 21 from the razor of the present invention, the shaving cream dispenser 13 containing the shaving cream 22 is placed in the chamber 14 of the body member 10. After attaching the removable cap 12 and the handle member 21 to the body member 10, the shaving cream 22 is dispensed by pressing the handle member 21 which squeezes the dispenser 13 causing the shaving cream to flow from the dispenser 13 to the cotton surface plate 19 through the head chamber 16. Since the shaving cream dispenser 13 is secured to the body member 10 by the stop members 24 secured on both sides of the hole 15 and the hook member 23 is engaged with the raised portion 26 on the inside of the chamber 14, the shaving cream dispenser 13 does not move during the squeezing of the dispenser 13 by the handle member 21. Furthermore, the shaving cream 22 which is passed through the plurality of the small holes 17 uniformly is distributed through numerous small apertures of the cotton surface plate 19 so that it is easy to use the shaving device of the present invention.

What is claimed is:

1. A razor containing a shaving cream dispenser comprising:

a body member having a chamber disposed therein and a handle member slidably disposed thereon, said chamber containing a shaving cream dispenser disposed therein, said dispenser including an outlet end contained stop members at one end thereof, said stop members being fixed on opposite sides of a hole provided in a partition between the head chamber and the chamber of the body member, a head member disposed at one end of said body member, and a removable cap disposed at the other end of said body member whereby the shaving cream is dispensed from the shaving cream dispenser through the head member by pressing the handle member against the shaving cream dispenser.

2. The razor containing a shaving cream dispenser of claim 1 wherein the head member contains a plurality of holes on one side thereof, said head member being provided with a cotton surface plate for uniformly distributing the shaving cream to a shaving area.

3. The razor containing a shaving cream dispenser of claim 1 wherein the shaving cream dispenser includes a flat portion and a hook member disposed at the other end thereof, said hook member engaging a raised portion disposed on the inside of the chamber of the body member.

4. The razor containing a shaving cream dispenser of claim 1 wherein the dispenser is made of a flexible material.

5. The razor containing a shaving cream dispenser of claim 1 wherein the body member is provided with a transparent portion at the side thereof for indicating the amount of a shaving cream remaining in the shaving cream dispenser.

6. The razor containing a shaving cream dispenser of claim 1 wherein the body member is provided with rubber gasket covers through which the handle member extends.

* * * * *